US005906969A

United States Patent [19]

Fyfe

[11] Patent Number: 5,906,969

[45] Date of Patent: May 25, 1999

[54] HIGH FUEL ECONOMY PASSENGER CAR ENGINE OIL

[75] Inventor: Kim Elizabeth Fyfe, Sarnia, Canada

[73] Assignee: Exxon Research and Engineering Company, Florham Park, N.J.

[21] Appl. No.: 09/071,291

[22] Filed: May 1, 1998

[51] Int. Cl.[6] ..... C12M 141/12

[52] U.S. Cl. ..... 508/364

[58] Field of Search ..... 508/364

[56] References Cited

U.S. PATENT DOCUMENTS

| | | | |
|---|---|---|---|
| 3,772,197 | 11/1973 | Milson | 508/364 |
| 4,846,983 | 7/1989 | Ward, Jr. | 508/364 |
| 5,356,547 | 10/1994 | Arai et al. | 508/364 |
| 5,658,862 | 8/1997 | Vrahopoulou | 508/192 |
| 5,665,684 | 9/1997 | Arai et al. | 508/364 |
| 5,672,572 | 9/1997 | Arai et al. | 508/364 |

*Primary Examiner*—Jacqueline V. Howard
*Attorney, Agent, or Firm*—Joseph J. Allocca

[57] ABSTRACT

A lubricating oil for improving the fuel economy of internal combustion engines is disclosed comprising a major amount of a lubricating oil base stock and a minor amount of an additive package which comprises in combination a molybdenum dithiocarbamate friction modifier, a mixture of calcium and magnesium salicylate and magnesium sulfonate detergent, and alkylated (alkoxy) amine. In addition the engine lubricant can include other typical engine oil lubricant additives including dispersants, anti-foaming agents, anti-oxidants, anti-wear additives, demulsifiers, etc.

8 Claims, No Drawings

HIGH FUEL ECONOMY PASSENGER CAR ENGINE OIL

BACKGROUND OF THE INVENTION

1. Field of the Invention

The present invention relates to lubricating oils for use in internal combustion engines which increase the fuel economy of said engines.

2. Description of the Related Art

In recent years great emphasis has been placed by engine manufacturers in increasing the fuel economy and efficiency of their engines in order to meet the Federal Corporate Average Fuel Economy (CAFE) standards. While a significant portion of such improvement has and will be achieved by improvements in engine design and operation, a major role can be played by the lubricants used in said engines. Lubricants finction to reduce and disperse engine deposits which accumulate when the engines are running. They also serve to reduce the friction between moving parts which are in metal surface to metal surface contact.

Numerous additives have been introduced into lubricating oils to enhance the ability of base oils to disperse contaminants, resist oxidation, reduce frictional losses and serve as metal deactivators, extreme pressure additives, viscometric property improvers, rust inhibitors, anti-foaming agent, detergents and so forth.

U.S. Pat. No. 5,114,602 is directed to lube oils containing borated succinimide ashless dispersants which also show a reduced tendency to degrade engine seals.

U.S. Pat. No. 5,356,547 is directed to a lube oil having a low coefficient of friction and reduced copper corrosivity containing at least one organomolybdenum compound selected from the group consisting of sulfirized oxymolybdenum dithiocarbamate and sulfurized oxymolybdenum organophosphororodithioate phosphorodithioate as friction modifiers, and at least one organozinc compound selected from the group consisting of zinc dithiophosphate and zinc dithiocarbamate as extreme pressure, anti-oxidant and corrosion inhibiting agents, and an organic acid amide which serves to reduce the coefficient of friction at an early stage of engine running after startup while inhibiting copper corrosion.

U.S. Pat. No. 4,801,390 is directed to a lubricating oil composition containing an ashless dispersant which is a polyisobutylene succinic anhydride reacted with a polyethylene amine and subsequently treated with a boron compound.

EP 562172 is directed to an engine oil composition containing a natural or synthetic base oil stock, a boron compound derivative of an alkenylsuccinimide, an alkaline earth metal salt of salicylic acid and one or both of a molybdenum dithiophosphate and molybdenum dithiocarbamate. The lube oil formulation may also contain viscosity index improvers such as polymethacrylate, polyisobutylene, ethylene-propylene copolymers, etc., pour point depressants such as polyalkylmethacrylates, antioxidants such as hindered phenolic compounds and dispersant/detergents such as sulfonates, phenates and the like.

It would be desirable to improve the fuel economy properties of engine oils substantially containing the currently industry accepted additives.

SUMMARY OF THE INVENTION

The present invention relates to a lubricating oil formulation for an internal combustion engine, which formulation improves the fuel efficiency found in the engine, the formulation comprising a major portion of an oil base stock in the lubricating oil boiling and viscosity range and a minor amount of additives comprising a molybdenum dithiocarbamate, a mixture of at least two salicylates of different alkaline earth metals, an alkaline earth metal sulfonate and alkylated dialkoxyamine.

DETAILED DESCRIPTION OF THE INVENTION

The engine oil lubricant of the invention comprises a major amount of a natural or synthetic oil or mixtures thereof, boiling in the lubricating oil boiling range and of lubricating oil viscosity and a minor amount of a fuel economy improving additive package.

The engine oil according to the invention requires a major amount of lubricating oil basestock. The lubricating oil basestock can be derived from natural lubricating oils, synthetic lubricating oils, or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude. In general, the lubricating oil basestock will have a kinematic viscosity ranging from about 2 to about 1,000 cSt at 40° C. Preferably, the base stock will be selected so that the final lubricant will be an SAE 5W-30 grade, most preferably a 5W-20 grade lubricant formulation.

Consequently, it is preferred that the lubricating oil base stock used has a kinematic viscosity of between about 17 to 19 cSt, most preferably about 17.5 to 18.5 cSt at 40° C.

Natural lubricating oils include animal oils, vegetable oils (e.g., castor oils and lard oil), petroleum oils, mineral oils, and oils derived from coal or shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The resulting isomerate product is typically subjected to solvent dewaxing and fractionation to recover various fractions of specific viscosity range. Wax isomerate is also characterized by possessing a very high viscosity index, generally having a VI of at least 130, preferably at least 135 and higher and, following dewaxing, a pour point of about −20° C. and lower.

The production of wax isomerate oil meeting the requirements of the present invention is disclosed and claimed in U.S. Pat. No. 5,059,299 and U.S. Pat. No. 5,158,671.

Molybdenum dithiocarbamates are employed as the friction modifier, are represented by the formula:

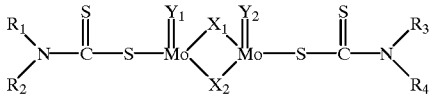

where $R_1$, $R_2$, $R_3$ and $R_4$ each independently represent a hydrogen atom, a $C_1$ to $C_{20}$ alkyl group, a $C_6$ to $C_{20}$ cycloalkyl, aryl, alkylaryl or aralkyl group, or a $C_3$ to $C_{20}$ hydrocarbyl group containing an ester, ether, alcohol or carboxyl group; and $X_1$, $X_2$, $Y_1$ and $Y_2$ each independently represent a sulfur or oxygen atom.

Examples of suitable groups for each of $R_1$, $R_2$, $R_3$ and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. Preferably $R_1$ to $R_4$ are each $C_6$ to $C_{18}$ alkyl groups, more preferably $C_{10}$ to $C_{14}$.

It is preferred that $X_1$ and $X_2$ are the same, and $Y_1$ and $Y_2$ are the same. Most preferably $X_1$ and $X_2$ are both sulfur atoms, and $Y_1$ and $Y_2$ are both oxygen atoms.

Molybdenum dithiocarbamates are available commercially, the R. T. Vanderbilt Company being one such source.

Examples of molybdenum dithiocarbamates include $C_6$–$C_{18}$ dialkyl or diaryldithiocarbamates, or alkylaryldithiocarbamates such as dibutyl-, diamyl-di-(2-ethylhexyl)-, dilauryl-, dioleyl-, and dicyclohexyldithiocarbamate. At least one of molybdenum dithiocarbamate is used in the engine oil. The amount of molybdenum dithio carbamate(s) present in the oil, expressed in terms of molybdenum atoms, ranges from 100 to 2000 ppm, preferably 250 to 1500 ppm, most preferably 400 to 600 ppm.

Detergents used comprise a mixture of alkaline earth metal salicylates, of at least two different alkaline earth metals, and at lease one alkaline earth metal sulfonate(s). The preferred alkaline earth metals are calcium and magnesium.

The total amount of alkaline earth metal salicylates used in the oil formulation, in terms of total metal atoms is in the range 1000 to 2500 ppm, preferably 1200 to 2200 ppm, most preferably 1600 to 2000 ppm.

The amount of metal sulfonate present in the formulation in terms of total metal atoms is in the range 300 to 900 ppm, preferably 500 to 700 ppm, based on base stock.

The ratio of the mixture of mixed alkaline earth metal, preferably mixed calcium and magnesium metal, salicylate to alkaline earth metal sulfonate based on metal atoms present is in the range 3 to 1 to 1 to 1, preferably about 2 to 1.

While the use of the mixture of alkaline earth metal salicylates, preferably calcium and magnesium salicylate in combination with the metal sulfonate, preferably calcium sulfonate has been found to result in an improvement in fuel efficiency as compared with the use of a mixture of alkaline earth salicylates, or mixed magnesium sulphonate and calcium sulfonate alone, it has further been found, unexpectedly, that the addition of an alkylated (alkoxy) amine results in a still further improvement in the fuel efficiency of the oil.

Alkylated (alkoxy) amines used in the present formulation are represented by the formula:

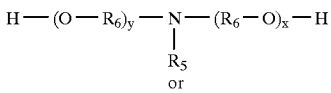

(A)

or

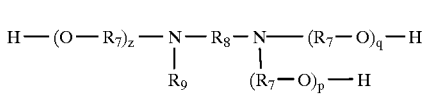

(B)

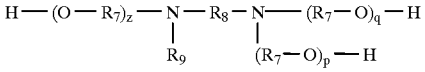

(B)

wherein $R_5$ and $R_9$ are independently $C_1$ to $C_{30}$ hydrocarbyl radicals, $R_6$ and $R_7$ are independently $C_2$ to $C_6$ hydrocarbyl radicals, $R_8$ is a $C_1$ to $C_6$ hydrocarbyl radical, x and y are integers from 0 to 50 provided that $0<(x+y)\leqq 50$, and p, q and z are integers from 0 to 50 provided $0<(p+q+z)\leqq 50$.

Preferably, $R_5$ and $R_9$ are independently $C_1$ to $C_{30}$ straight or branch chain alkyl, alkenyl, alkynyl or an aryl substituted aliphatic chain where the aliphatic chains are attached to the nitrogen atom(s) in the molecule. More preferably $R_5$ and $R_9$ are $C_{12}$ to $C_{20}$ alkyl or alkenyl, even more preferably a mixture of $C_{14}$, $C_{16}$ and $C_{18}$ alkyl or alkenyl substituents.

Preferably, $R_6$ and $R_7$ are independently $C_2$ to $C_6$ straight or branched alkyl, alkenyl, alkynyl diradicals, more preferably a $C_2$ to $C_4$ alkyl diradical, most preferably a $C_2$ diradical.

Preferably, $R_8$ is a $C_1$ to $C_6$ alkyl, alkenyl, alkynyl diradical, more preferably $R_8$ is a $C_2$ to $C_4$ alkyl diradical, most preferably a $C_3$ alkyl diradical.

Preferably, x and y are integers from 1 to 25, provided $1\leqq(x+y)\leqq 25$, more preferably 1 to 15 provided $1\leqq(x+y)$ 15.

Preferably p, q and z are integers from 1 to 25 provided $1\leqq(p+q+z)\leqq 25$, more preferably 1 to 15, provided $1\leqq(p+q+z)\leqq 15$.

A particularly preferred alkoxylated amine is ETHODUOMEEN T-13 (commercially available from Akzo Chemical). ETHODUOMEEN T-13 has Structure B wherein $R_9$ is tallow ($C_{12}$–$C_{18}$), $R_8$ is $CH_2CH_2$, $R_7$ is $CH_2CH_2$ and p+z=3. The amount of alkylated dialkoxy amine used is in the range 0.05 to 1 wt %, preferably 0.3 to 0.5 wt % (based on active ingredient).

Various other additives may also be present in the fmal formulated engine oil at the discretion of the practitioner to meet various other oil performance targets.

Thus dispersants such as succinimides substituted with polyalkenyl of about 500 to 5000 Mn, preferably 900–1500 Mn, most preferably about 900–950 Mn, preferably borated poly alkenyl succinimide as described in U.S. Pat. No. 4,863,624 may be used. Preferred borated dispersants are boron derivatives derived from polyisobutylene substituted with succinic acid or anhydride groups and reacted with amine, preferably polyalkylene amines, polyoxyethylene amines, and polyol amines. Such dispersants are preferably added in an amount from 2 to 16 wt %, based on oil composition. The borated dispersants are "over-borated", i.e., they contain boron in an amount from 0.5 to 5.0 wt % based on dispersants. These over-borated dispersants are available from Exxon Chemical Company. The amount of boron in the engine oil should be at least about 500 ppmw, preferably about 900 ppmw. In addition to borated dispersants, other sources of boron which may contribute to the total boron concentration include borated dispersant VI improvers and borated detergents.

Antioxidants which can be used include hindered phenol compounds such as nonyl phenol sulfide, oil soluble molybdenum and/or copper salt such as the copper and/or molybdenum salts of synthetic or natural organic acids, preferably mono- and dicarboxylic acids. With respect to the copper salts, preferred carboxylic acids are $C_{10}$ to $C_{30}$ saturated and unsaturated fatty acids and polyisobutenyl succinic acids and their anhydrides wherein the polyisobutenyl butenyl group has a number average molecular weight of 700 to 2500. Examples of preferred copper salts include copper oleate, copper stearate, copper naphthenate and the copper salt of polyisobutenyl succinic acid or anhydride wherein the polyisobutenyl group has an average molecular weight 800–1200. The amount of copper salt is preferably from 0.01 to 0.3 wt %, preferably about 0.05 to 0.1 wt % based on lubricating oil composition. With respect to the molybdenum salts the preferred carboxylic acids are $C_4$ to $C_{30}$ saturated and unsaturated fatty acids. Examples of preferred molybdenum salts include molybdenum naphthenate, hexanoate, oleate, xanthate and tallate. The amount of molybdenum salt is preferably from 0.01 to 3.0 wt %, based on lubricating oil composition.

Again, the amount of these additives used, if at all, is left to the discretion of the practitioners.

Diaryl amines and substituted diarylamines, such as diphenyl amine or phenyl-naphthyl amines are also typical and well known antioxidants which may be present in engine lubricating oils.

Typical antiwear additives used in engine lubricating oils are metal 1° and 2° dialkyl dithio phosphates, preferably zinc dialkyl dithiophosphate ZDDP, used in an amount in terms of total phosphorus of about 800 to 1500 ppm, preferably 900 to 1100 ppm.

Viscosity index improvers such as polyalkyl(meth) acrylates or polyolefms or hydrogenated styrene-diene, e.g., styrene-isoprene copolymer can be used to enhance the viscometries of the final formulations. A preferred type of VI improver is polyalkyl (meth) acrylate.

Demulsifier and anti foamant agents may also be employed, as needed.

Additives generally useful in lubricating oil formulations are described in "Lubricants and Related Products" by Dieter Klamann, Verlag Chemie, Weinheim, Germany, 1984. "Chemistry and Technology of Lubricants", R. M. Mortfier and S. T. Orsulik, editors, Blackie, Glasgaw & London VCH Publishers, Inc., New York, 1992.

The lubricating oil compositions can be used in the lubricating systems of any internal combustion engine such as automobile and truck engines, marine engines and railroad engines, preferably as multigrade lubricating oil compositions used in the lubrication systems of spark ignition internal combustion engines.

The invention may be further understood by reference to the following non-limiting examples.

EXPERIMENTAL

In the following examples, which includes comparative examples, fuel economy was measured by using the modified Sequence VI test employing a 1982 Buick V-6 engine.

EXAMPLES

The formulations discussed are contained in Tables 1. The Kinematic Viscosity at 100° C. was set at 8.9 cSt for the 20 grades. The 5W grade CCS target was set for 3000 cP. All blends use a hydrocracked 100N petroleum base stock.

Formulation A is composed of a mixture of borated polyisobutylene-polyamine type dispersants, the antioxidants nonyl phenol sulfide, copper PIBSA, copper oleate and diaryl amine, mixed 1° and 2° ZDDP antiwear additives, overbased magnesium sulfonate and calcium sulfonate detergents, molybdenum dithiocarbamate friction modifier, plus a small amount of demulsifier and antifoam.

In Table 1, Formulations A, B, and C demonstrate the difference in performance achieved by the use of oil formulations containing different combinations of detergent. Formulation A contains the simple combination of magnesium sulfonate and calcium sulfonate, Formulation B contains the simple combination of calcium salicylate and magnesium salicylate, and Formulation C contains the more complex combination of calcium and magnesium salicylate and calcium sulfonate. All three formulations contain MoDTC friction modifier.

Formulation D demonstrates the effect of changing the friction modifier to a mixture of MoDTC and diethoxyamine in oil formulations which are substantially the same in terms of the other additive components.

Comparing Formulations A, B and C of Table 1 reveals that, all else being equal, the use of a multi component detergent results in an unexpected improvement in the Sequence VI modified engine test in terms of % EFEI.

Comparing Formulations C and D reveals that additional use of alkylated dialkoxy amine results in further improvement in fuel economy.

TABLE 1

| | Wt % | | | |
|---|---|---|---|---|
| | A 5280-6903 | B 6902 | C 5280-6702 | D 5280-6904 |
| Basestock | 82.58 | | | |
| Disp - Borated PIBSA PAM | 6.80 | 6.80 | 6.80 | 6.80 |
| Antioxidants | 1.63 | 1.63 | 1.63 | 1.63 |
| ZDDP | 1.36 | 1.36 | 1.36 | 1.36 |
| Demulsifier | 0.01 | 0.01 | 0.01 | 0.01 |
| Antifoam | 0.001 | 0.001 | 0.001 | 0.001 |
| VII - PMA | 5.00 | 4.70 | 4.80 | 5.00 |

TABLE 1-continued

| | Wt % | | | |
|---|---|---|---|---|
| | A 5280-6903 | B 6902 | C 5280-6702 | D 5280-6904 |
| Detergents | | | | |
| Ca Sulfonate (300 TBN) | 0.40 | — | 0.50 | 0.50 |
| Mg Sulfonate (400 TBN) | 1.50 | — | — | — |
| Ca Salicylate (70 TBN) | — | 2.27 | 0.90 | 0.90 |
| Mg Salicylate (270 TBN) | — | 0.57 | 1.60 | 1.60 |
| FM - MoDTC | 1.10 | 1.10 | 1.10 | 1.10 |
| Diethoxy Amine (Ethoduomeen) | — | — | — | 0.40 |
| % EFEI | 2.7 | 4.1 | 4.4 | 4.9 |

What is claimed is:

1. A lubricating oil useful for increasing the fuel economy of internal combustion engines comprising a major amount of a lubricating oil base stock selected from the group consisting of natural oils, synthetic oils and mixtures thereof, and a minor amount sufficient to improve the fuel economy of the lubricating oil fuel economy improving additives comprising:

(1) a molybdenum dithiocarbamate of the formula:

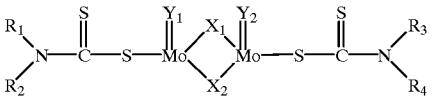

wherein in $R_1$, $R_2$, $R_3$ and $R_4$ each independently represent a hydrogen atom, a $C_1$ to $C_{20}$ alkyl group, a $C_6$ to $C_{20}$ cycle alkyl, aryl alkyl aryl or aralkyl group or a $C_3$ to $C_{20}$ hydrocarbyl group containing an ester, ether alcohol or carboxyl group, and $X_1$, $X_2$, $Y_1$ and $Y_2$ each independently represent a sulfur or oxygen atom;

(2) a mixture of alkaline earth metal salicylates of at least two different alkaline earth metals, in combination with at least one alkaline earth metal sulfonate; and (3) an alkylated (alkoxy) amine.

2. The lubricating oil composition of claim 1 wherein the alkaline earth metal salicylate are calcium salicylate and magnesium salicylate and the alkaline earth metal sulfonates is at least one calcium sulfonate, magnesium sulfonates.

3. The lubricating oil composition of claim 1 wherein the alkylated (alkoxy) amine is of the formula

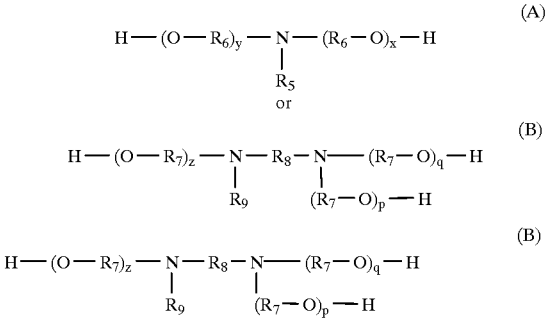

wherein $R_5$ and $R_9$ are independently $C_1$ to $C_{30}$ hydrocarbyl radicals, $R_6$ and $R_7$ are independently $C_2$ to $C_6$ hydrocarbyl radicals, $R_8$ is a $C_1$ to $C_6$ hydrocarbyl radical, x and y are integers from 0 to 50 provided that $0<(x+y)\leqq 50$, and p, q and z are integers from 0 to 50 provided $0<(p+q+z)\leqq 50$.

4. The lubricating oil composition of claim 1, 2 or 3, wherein molybdenum dithiocarbamate is present in the oil in an amount in the range from 100 to 2000 ppm based on molybdenum atoms, alkaline earth metal salicylate are present in the oil in an amount in the range from 1000 to 2500 ppm based on total metal atoms, alkaline earth metal sulfonate is present in the oil in the range 300 to 900 ppm based on total metal atoms. and alkylated (alkoxy) amine present on the oil in an amount in the range 0.05 to 1 wt % based on active ingredient.

5. A method for improving the fuel economy of a lubricating oil used in an internal combustion engine comprising a lubricating oil base stock and additive, by adding to the lubricating oil a minor amount of a fuel economy improving additive package comprising:

(1) a molybdenum dithiocarbamate of the formula:

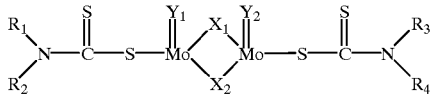

wherein in $R_1$, $R_2$, $R_3$ and R4 each independently represent a hydrogen atom, a $C_1$ to $C_{20}$ alkyl group, a $C_6$ to $C_{20}$ cycle alkyl, aryl alkyl aryl or aralkyl group or a $C_3$ to $C_{20}$ hydrocarbyl group containing an ester, ether alcohol or carboxyl group, and $X_1$, $X_2$, $Y_1$, and $Y_2$ each independently represent a sulfur or oxygen atom;

(2) a mixture of alkaline earth metal salicylates of at least two different alkaline earth metals, in combination with at least one alkaline earth metal sulfonate; and (3) an alkylated (alkoxy) amine.

6. The method of claim 5 wherein the alkaline earth metal salicylate are calcium salicylate and magnesium salicylate and the alkaline earth metal sulfonates is at least one calcium sulfonate, magnesium sulfonates.

7. The method of claim 5 wherein the alkylated (alkoxy) amine is of the formula

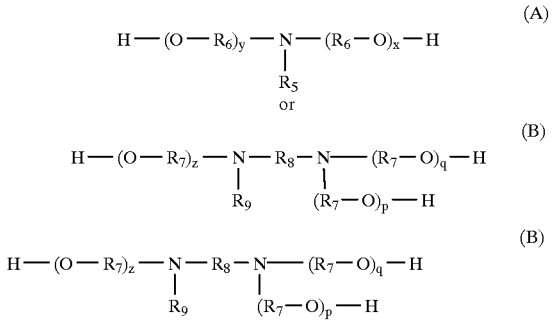

wherein $R_5$ and $R_9$ are independently $C_1$ to $C_{30}$ hydrocarbyl radicals, $R_6$ and $R_7$ are independently $C_2$ to $C_6$ hydrocarbyl radicals, $R_8$ is a $C_1$ to $C_6$ hydrocarbyl radical, x and y are integers from 0 to 50 provided that $0<(x+y)\leqq 50$, and p, q and z are integers from 0 to 50 provided $0<(p+q+z)\leqq 50$.

8. The method of claims 5, 6 or 7 wherein molybdenum dithiocarbamate is present in the oil in an amount in the range from 100 to 2000 ppm based on molybdenum atoms, alkaline earth metal salicylates are present in the oil in an amount in the range from 1000 to 2500 ppm based on total metal atoms, alkaline earth metal sulfonate is present in the oil in the range 300 to 900 ppm based on total metal atoms. and alkylated (alkoxy) amine present on the oil in an amount in the range 0.05 to 1 wt % based on active ingredient.

* * * * *